US006595193B2

(12) United States Patent
Pettersson

(10) Patent No.: US 6,595,193 B2
(45) Date of Patent: Jul. 22, 2003

(54) METHOD AND ARRANGEMENT AT A MULTIPLE CYLINDER FOUR-STROKE CYCLE INTERNAL COMBUSTION ENGINE

(75) Inventor: Magnus Pettersson, Sodertalje (SE)

(73) Assignee: Scania CV AB (SE)

( * ) Notice: Subject to any disclaimer, the term of this patent is extended or adjusted under 35 U.S.C. 154(b) by 0 days.

(21) Appl. No.: 10/257,685

(22) PCT Filed: Apr. 10, 2001

(86) PCT No.: PCT/SE01/00803

§ 371 (c)(1),
(2), (4) Date: Oct. 9, 2002

(87) PCT Pub. No.: WO01/79679

PCT Pub. Date: Oct. 25, 2001

(65) Prior Publication Data

US 2003/0089354 A1 May 15, 2003

(30) Foreign Application Priority Data

Apr. 14, 2000 (SE) ..... 0001402

(51) Int. Cl.[7] ..... F02P 1/00
(52) U.S. Cl. ..... 123/613; 123/643; 123/615
(58) Field of Search ..... 123/613, 612, 123/643, 594, 615

(56) References Cited

U.S. PATENT DOCUMENTS 4,459,968 A * 7/1984 Brandt et al. ..... 123/643
4,616,617 A 10/1986 Geiger et al. ..... 123/436
5,068,741 A * 11/1991 Takahashi ..... 358/296

FOREIGN PATENT DOCUMENTS

DE 19844910 4/2000
EP 0684375 11/1995

* cited by examiner

*Primary Examiner*—Bibhu Mohanty
(74) *Attorney, Agent, or Firm*—Ostrolenk, Faber, Gerb & Soffen, LLP

(57) ABSTRACT

In a multiple cylinder four-stroke engine with fuel injection, an interference oscillation is generated briefly on the flywheel on starting by varied fuel supply to different cylinders. After oscillation analysis of the resultant oscillation of the flywheel, phase positions of the superimposed interference oscillation and of the resultant oscillation are compared. If predetermined phase positions of the oscillations appear, the engine is considered to be operating in the correct cycle position, but otherwise a control unit is initiated to correct its cycle position so that the correct cycle position of the engine is obtained.

25 Claims, 3 Drawing Sheets

METHOD AND ARRANGEMENT AT A MULTIPLE CYLINDER FOUR-STROKE CYCLE INTERNAL COMBUSTION ENGINE

TECHNICAL FIELD

The present invention relates to on the one hand a method of determining where the cylinders of a multiple cylinder engine are operating during their operating cycle and for adjusting the cycle positions of the cylinders and on the other hand to an arrangement for the determining and adjusting.

STATE OF THE ART

In internal combustion engines of the four-stroke type, the camshaft rotates at half the crankshaft speed, as a result of which the rotary position of the camshaft at any moment clearly indicates where in its operating cycle, or in which cycle position, a given cylinder is located. By studying the rotary position of the camshaft, it is therefore possible to determine whether the current position of the piston in a cylinder is to be assigned to the first or the second crankshaft revolution in each operating cycle of the cylinder. By means of camshaft sensors, it is thus possible to provide, for example, an electronic control unit for a fuel injection system with reliable information about the cycle position in a cylinder, so that fuel injection can always take place at the correct time.

However, such camshaft sensors are relatively difficult to install and to make sufficiently robust, for which reason it would be desirable for it to be possible to utilize simpler systems but still achieve good precision and reliability. In electronic fuel injection systems, the failure of such a camshaft sensor can result in functional problems, as the possibility of determining the current cycle position is thus lost.

It has also been found to be difficult to use only flywheel sensors instead, as uncertainty arises about which of two crankshaft revolutions the engine is in at the time. Another problem in this context is that an electronic control unit, for example in connection with being started or after a programming change or the like, cannot retain stored information about the position in which the crankshaft last stopped, but has to be synchronized with the engine again. Furthermore, the crankshaft may, since the engine stopped, have been rotated as a result of the vehicle having been moved with a gear engaged. Such circumstances may result in the control unit misinterpreting the situation and operating in an incorrect cycle position, with attendant operating problems.

Against this background, a requirement exists for improved solutions within this field.

THE OBJECT OF THE INVENTION

An object of the invention is to make it possible, without recourse to camshaft sensors, to determine reliably the cycle position of a cylinder in a multiple cylinder four-stroke engine. Another object is to produce a simple and safe solution.

DISCLOSURE OF THE INVENTION

These objects are achieved according to the invention by means of on the one hand a method for superimposing interference oscillations on the engine flywheel and then determining if the phase of the interference oscillations is in a predetermined relationship to the phase of the resultant oscillations on the flywheel caused by the ignition impulses and the superimposed interference oscillations; and adjusting the engine cycle position, i.e. where in the cycle fuel is injected to each of the cylinders, to attain the predetermined relationship of the phases, having on the other hand an arrangement having a control unit which applies the interference oscillations, senses the rotation angle of the flywheel, determines if the cycle position is correct or not, and causes corrections of an incorrect cycle position to provide the predetermined phase relationship.

By, according to the invention, dispensing with camshaft sensors and using only a flywheel sensor (crankshaft sensor), a simpler, more robust sensor arrangement is obtained. In order for it then to be possible to determine, on starting, in which crankshaft revolution of the two revolutions of an operating cycle a cylinder is located, the flywheel is subjected to an interference oscillation in addition to the ordinary ignition pulse oscillation. The superimposed interference oscillation can be determined from the resultant oscillation, and, after comparison of phase positions of the superimposed interference oscillation and the interference oscillation, it is possible to establish which of the two crankshaft revolutions is correct for the cylinder. An electronic control unit which detects that the cycle position is incorrect is initiated to correct its cycle position by jumping the necessary number of steps in the ignition sequence of the engine, so that the correct cycle position is reached. A suitable interference oscillation is brought about by temporarily changing the fuel supply to the cylinders of the engine so that some cylinders receive more fuel and others receive less, according to a selected pattern.

By ensuring that a control unit can be set correctly on each starting operation, it is possible to use various types of control units with differing characteristics together with the engine with high reliability. The superimposed interference oscillation can be made virtually imperceptible for the driver of the vehicle by virtue of its frequency harmonizing with the ordinary oscillation and by virtue of the procedure being effected briefly at the beginning of the starting operation.

The arrangement produced according to the invention can be constructed using simple components and can therefore be made simple and robust.

Further features and advantages of the invention emerge from the description below.

The invention is described in greater detail below by means of illustrative embodiments shown in the accompanying drawing.

DESCRIPTION OF ILLUSTRATIVE EMBODIMENTS

In an internal combustion engine of the four-stroke type, an operating cycle of two crankshaft revolutions is performed for each cylinder, and ignition takes place once in each cylinder every other crankshaft revolution. A larger number of cylinders therefore means a larger number of ignitions per crankshaft revolution, a 4 cylinder engine having two ignitions per crankshaft revolution, for example, while a 6 cylinder engine has three ignitions and an 8 cylinder engine has four ignitions per crankshaft revolution. In cases where this type of engine is provided with fuel injection, it is important that fuel injection and ignition in each cylinder take place when the piston of the cylinder is located in the correct phase of its operating cycle.

Figure 1:
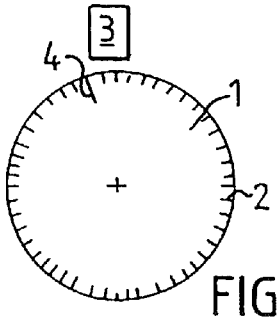
FIG. 1 shows a flywheel with associated rotation angle sensor.

FIG. 1 shows how a flywheel 1 of an otherwise not shown engine with fuel injection is provided with a number of indications 2, for example in the form of teeth, which are distributed in the circumferential direction and can be read off by a rotation angle sensor 3 during rotation of the flywheel. Arranged in a specific position on the flywheel 1 is a special indication 4 which tells the sensor 3 that the flywheel has rotated one revolution since the indication 4 last passed. By means of the sensor 3 and the indications 2, 4, the current rotary position of the flywheel can be established and, moreover, oscillations can be read off.

Figure 2:
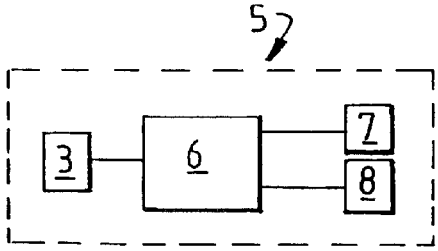
FIG. 2 shows a block diagram of an arrangement according to the invention.

According to FIG. 2, the sensor 3 forms part of an engine control system 5 and is connected to a control unit 6 which controls a fuel injection arrangement 7, by means of which the cylinders are provided with fuel at the correct moment. In the case of a diesel engine, ignition is also obtained at the correct moment. In the case of an Otto engine, the engine control system 5 also includes an ignition arrangement 8 which is controlled by the control unit 6 and by means of which ignition is carried out at the correct moment. For the sake of simplification, the invention will be described in greater detail below by illustrative embodiments relating to a 6-cylinder engine, but it can of course be applied to other engine sizes with a different number of cylinders.

Figure 3:
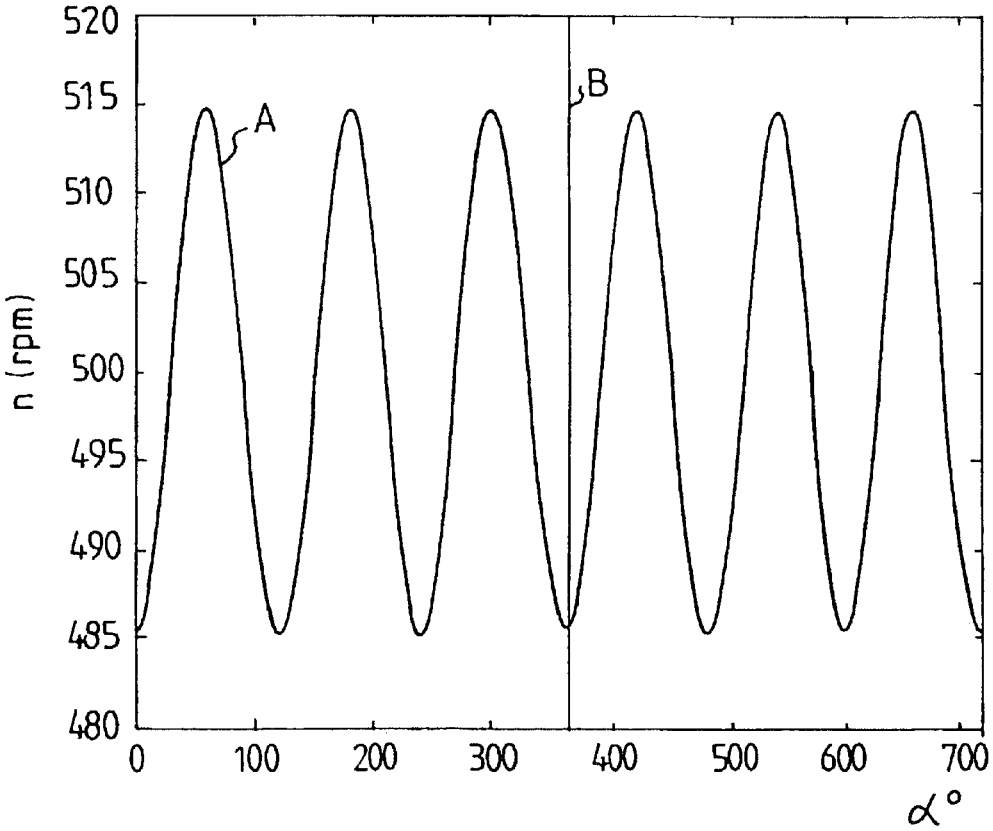
FIG. 3 shows normal ignition-pulse-generated speed variation on the flywheel at idling speed in a 6 cylinder engine.

The curve A in FIG. 3 shows how the speed of the flywheel varies at normal idling speed during two crankshaft revolutions as different cylinders ignite. The vertical axis indicates the speed n as the number of revolutions per minute (rpm), and the horizontal axis indicates the number of crankshaft degrees $\alpha$ from the position in which cylinder 1 in the ignition sequence ignites, which takes place at 0°. After cylinder 1, the other cylinders ignite in turn according to the ignition sequence of the engine at a mutual angular distance of 120°. Cylinder 2 therefore ignites at 120°, cylinder 3 at 240°, cylinder 4 at 360° etc. On each ignition, the speed increases to a peak and then falls before increasing again on the next ignition. The ignition frequency in this case is therefore three ignitions per crankshaft revolution, or six ignitions per operating cycle. The curve A shown can be said to represent the ordinary ignition pulse oscillation of the flywheel at idling speed. A vertical line B shows where the second crankshaft revolution begins at 360°.

When the engine is to be started, the sensor 3 does not know with certainty which cycle position a given cylinder is located in, that is to say in which half cycle or in which of two crankshaft revolutions of the operating cycle the flywheel is located in at the time. In order for the control unit 6 to operate correctly, however, it has to operate in the correct half cycle for each cylinder.

Figure 4:
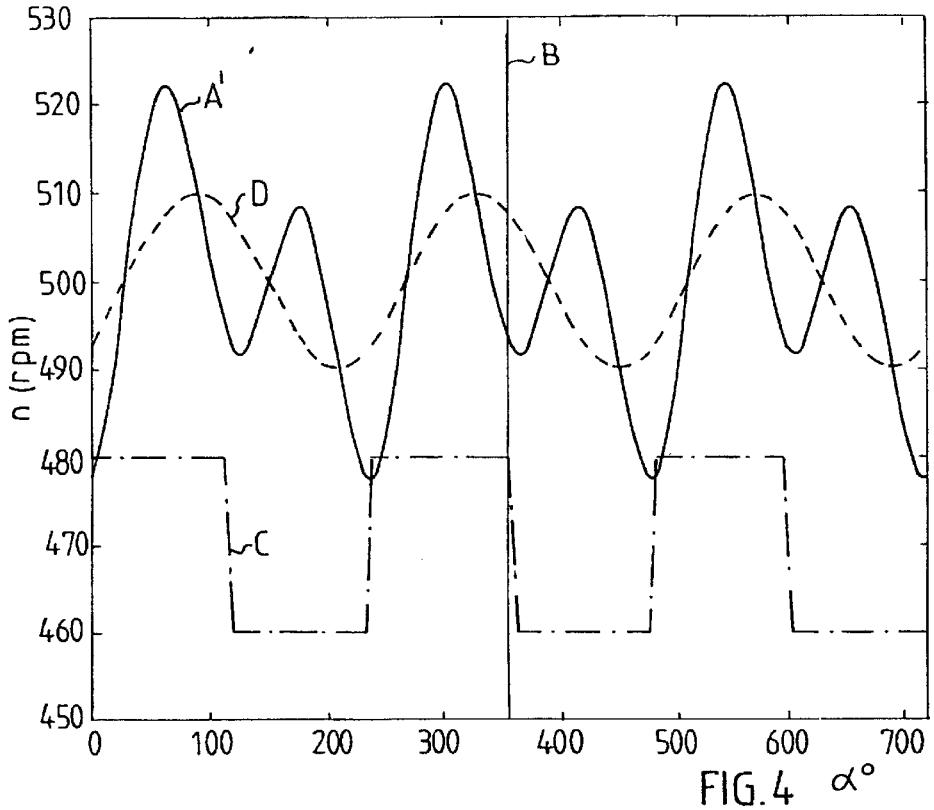
FIG. 4 shows speed variation corresponding to that in FIG. 3 but with a superimposed interference oscillation with a frequency corresponding to half the ignition frequency as a consequence of cylinders 1, 3 and 5 having been supplied more fuel than the other cylinders.

A solution to this problem can be obtained as follows: FIG. 4 shows how the oscillation shown in FIG. 3 according to the curve A has changed in character to become the curve A' by virtue of the quantity of fuel supplied to the cylinders having been changed in a predetermined manner. Cylinders 1, 3 and 5 have each had an equally large increase in the fuel quantity, and cylinders 2, 4 and 6 have each had a correspondingly large reduction in the fuel quantity. This fuel quantity variation is shown by the dot/dash curve C. The oscillation in the fuel quantity therefore has a frequency corresponding to half the ignition frequency and constitutes an interference oscillation on the flywheel. The control unit of the engine is here assumed to be operating in the correct cycle position.

As can be seen according to the curve A', a great increase in speed is logically obtained at cylinders 1, 3 and 5 as a consequence of the increased fuel quantity, whereas a small increase in speed is obtained at cylinders 2, 4 and 6 as a consequence of the reduced fuel quantity. By analysing the resultant oscillation obtained in the flywheel according to the curve A' in the control unit 6, the character of the superimposed interference oscillation caused by the fuel variation can be obtained by means of, for example, suitable band-pass filters. Such an oscillation pattern of the superimposed interference oscillation is shown diagrammatically and in principle by a dashed curve D. The frequency of this superimposed interference oscillation is half the frequency of the resultant oscillation according to the curve A'. As can be seen, the two oscillation curves C and D are in phase with one another, which means that the control unit is interpreting the cycle position in the engine correctly in this case.

Figure 5:
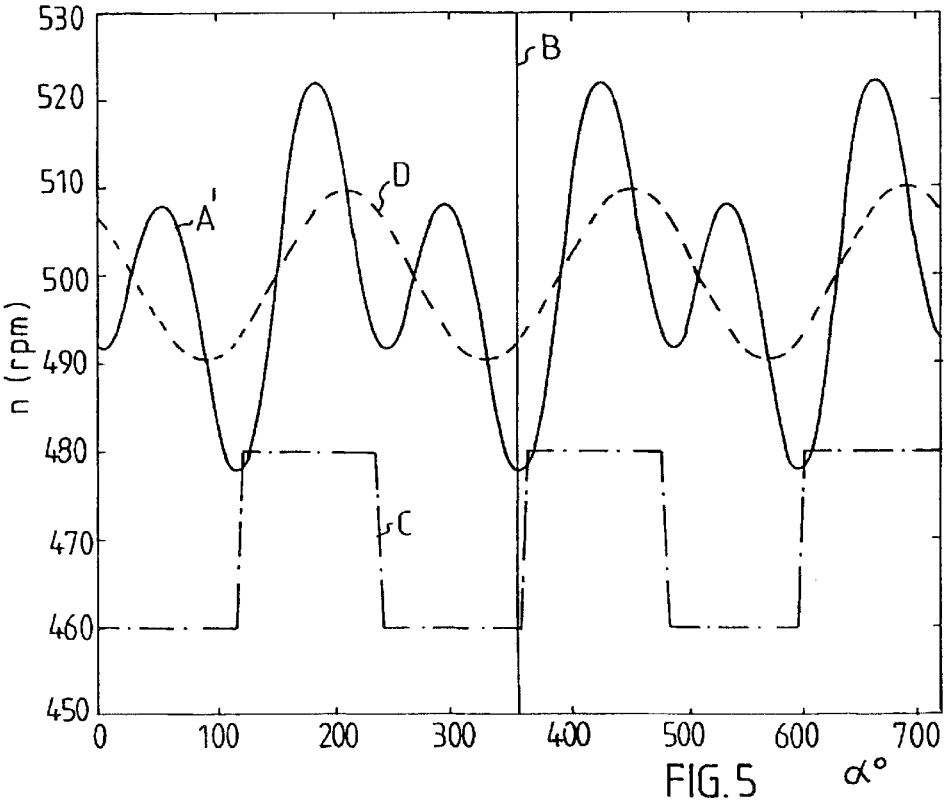
FIG. 5 shows speed variation corresponding to that in FIG. 4 but where cylinders 2, 4 and 6 instead have been supplied more fuel than the other cylinders.

FIG. 5 shows curves A', C and D corresponding to those in FIG. 4, but with the difference that it is now cylinders 2, 4 and 6 which have received a larger quantity of fuel than cylinders 1, 3 and 5. In this case as well, the two oscillation curves C and D are in phase with one another, which means that the control unit is interpreting the cycle position in the engine correctly.

Figure 6:
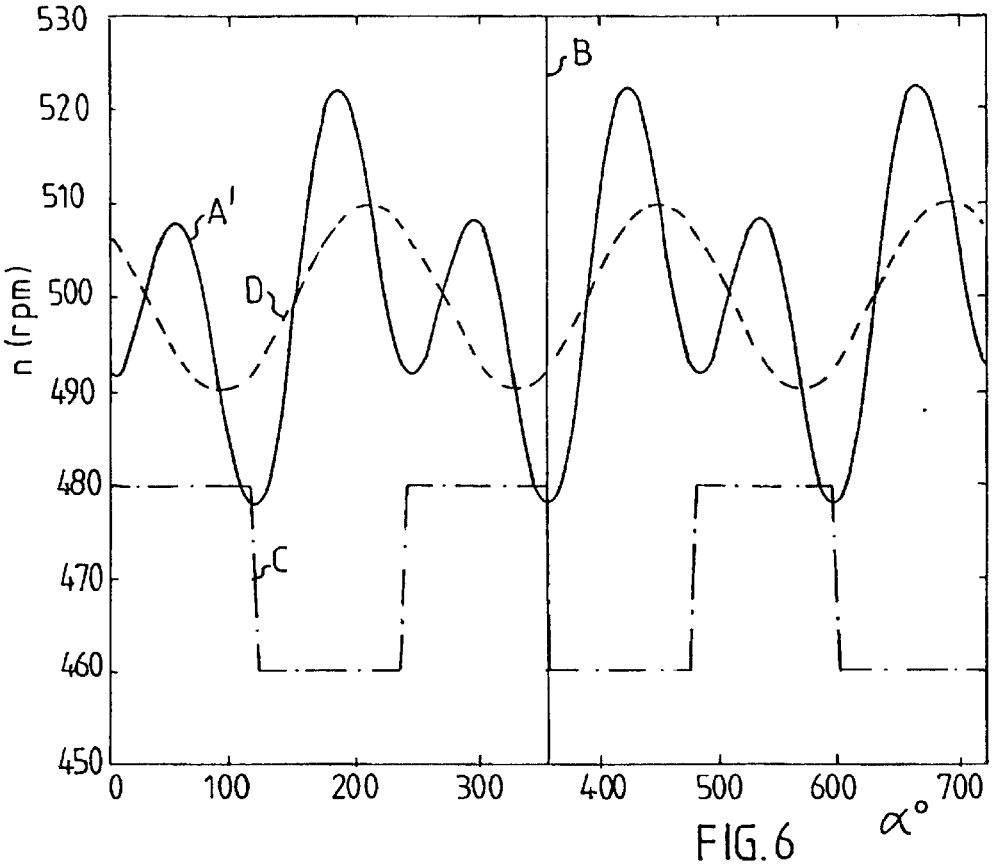
FIG. 6 shows the speed variation obtained with the fuel quantity according to FIG. 4 but with an incorrect cycle position.

FIG. 6 shows a situation in which the control unit is misinterpreting the cycle position, that is to say is one crankshaft revolution out. With the fuel distribution to the cylinders used in FIG. 4 according to the curve C, a curve pattern A' according to FIG. 5 will be obtained, in which the large speed peak shown at cylinder 1 in FIG. 4 now appears instead at cylinder 4, next to the line B, that is to say in the wrong crankshaft revolution. The curves C and D are not in phase with one another here.

By analogy with what is shown in FIG. 6, with the fuel distribution to the cylinders used in FIG. 5 according to the curve C, a curve pattern A' according to FIG. 4 will be obtained (not shown), in which the small speed peak shown at cylinder 1 in FIG. 5 now appears instead at cylinder 4, next to the line B, that is to say in the wrong crankshaft revolution. The curves C and D will not be in phase with one another here either. In the event of such detection of incorrect phase position between the curves C and D, the control unit 6 is according to the invention initiated to correct its cycle position by a change corresponding to one crankshaft revolution.

At an idling speed n of 600 rpm, there are 10 crankshaft revolutions per second. By making use of roughly 20 crankshaft revolutions on starting for the analysis indicated above, it is normally possible for a reliable analysis to be carried out, which in this case therefore takes roughly 2 seconds at the beginning of each starting operation. The superimposed interference oscillation, the frequency of which is equal to half the ignition frequency, harmonizes with the fundamental oscillation caused by the ignitions and is therefore not perceived as disruptive by the driver, to the extent that it can be perceived at all.

The interference oscillation is in normal conditions applied briefly, suitably for at most roughly 3 seconds, but preferably not for longer than roughly 2 seconds. Alternatively, it can be applied for at most roughly 30 crankshaft revolutions, but preferably not for more than roughly 20 crankshaft revolutions. In special situations, for example in the event of a fault of some sort in the engine, it may be difficult to establish the cycle position of the engine rapidly according to the above. In such emergencies, the test period can be extended to roughly 10–12 seconds.

Figure 7:
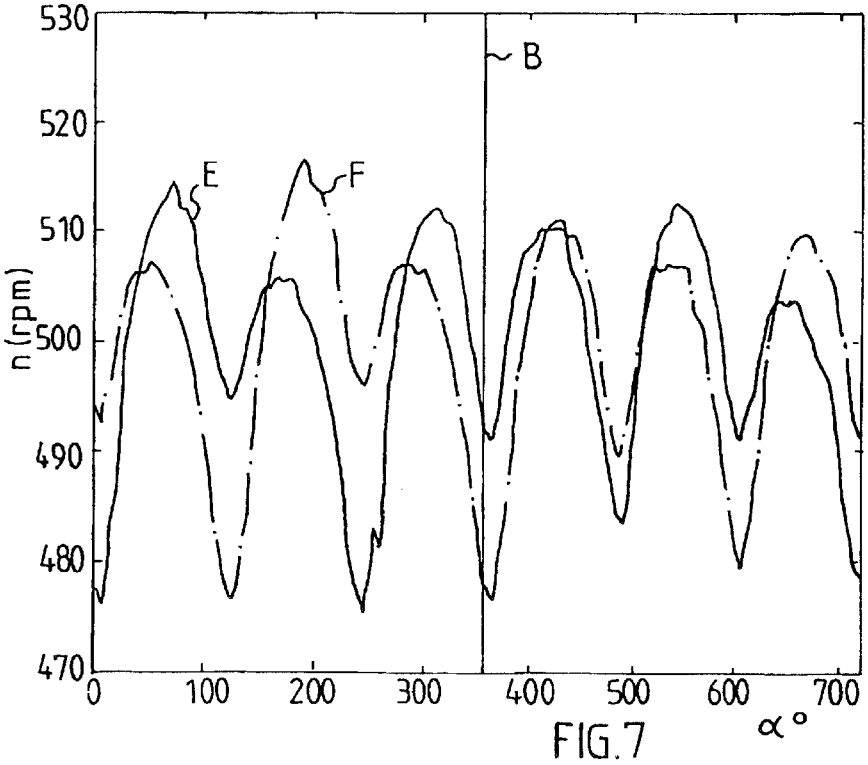
FIG. 7 shows speed variation of the flywheel with a superimposed oscillation according to FIG. 3, the solid curve showing the correct cycle position and the dot/dash curve showing an incorrect cycle position.

FIG. 7 shows the measurement result obtained for speed variation with a fuel quantity variation pattern according to FIG. 4. The solid curve E relates to the correct cycle position, and the dot/dash curve F relates to an incorrect cycle position. As can be seen, the peak on the solid curve E occurring at cylinder 1 does not appear until cylinder 4, next to the line B, on the dot/dash curve F. The curves E and F are therefore displaced by one revolution in the direction of rotation of the crankshaft or in this case, in a 6 cylinder engine, an odd number of ignition steps, namely three ignition steps.

The solution described above can be varied in a number of different ways within the scope of the invention, as required and desired. Therefore, for example, the superimposed interference oscillation can be built up by combining the fuel distribution patterns according to FIGS. 4 and 5, that is to say one pattern is used for a certain time and then the other. This renders simple checking of the result obtained possible. The size of the variation in the fuel supply to different cylinders can be adapted as necessary, so that the superimposed interference oscillation is sufficiently clear to allow analysis. Furthermore, the engine can of course have a number of cylinders different to that described above.

Depending on the type of fuel injection system used, it may be necessary to make possible a special start setting of the control device of the system in order to ensure that the engine can run briefly even with an incorrect cycle position during the time for which the interference oscillation is applied and before change-over to the correct cycle position has been effected.

What is claimed is:

1. A method of determining where in their operating cycles the cylinders of an engine are located for a multiple cylinder, four-stroke cycle, internal combustion engine with fuel injection, wherein the cylinders drive a crankshaft to rotate and a flywheel is on the driven crankshaft, the method comprising:

during operation of the engine, determining a rotation angle of the flywheel on the rotating crankshaft of the engine and generating a position signal representative of the rotation angle of the flywheel;

injecting a first amount of fuel to at least a first one of the cylinders and injecting a second amount of fuel different than the first amount of fuel to at least a second one of the cylinders for subjecting the rotating flywheel to ignition pulses each time an amount of fuel is injected which produce ignition pulse oscillations of the flywheel rotation as fuel is supplied to each cylinder and for also subjecting the flywheel to interference oscillations caused by the supplying of different amounts of fuel, wherein the interference oscillations have predetermined first phase positions;

the flywheel having a pattern of resultant oscillations resulting from the ignition pulses and from the interference oscillations superimposed on the ignition pulse oscillations, wherein the resultant oscillations have second phase positions; determining the superimposed interference oscillations and the first phase positions thereof from the resultant oscillations of the flywheel;

comparing the predetermined first phase positions of the interference oscillations with corresponding second phase positions of the resultant oscillation pattern, and if the predetermined first phase positions of the interference oscillations appear also for the second phase positions of the resultant oscillation pattern, then a control unit for fuel injection to the cylinder is considered to be operating in the correct cycle position; and if the predetermined first phase positions of the interference oscillations differ from the second phase position of the resultant oscillation pattern, the control unit for the fuel injection is considered to be operating in an incorrect cycle position, then operating the control unit to correct its cycle position by a number of steps in the ignition sequence until the correct cycle position is attained.

2. The method of claim 1, wherein the interference oscillation on the flywheel has a frequency corresponding to one-half the ignition pulse oscillation.

3. The method of claim 1, further comprising first starting the engine and thereby rotating the flywheel, applying the interference oscillation at the startup of the engine, and at starting of the engine, determining the rotation angle of the flywheel.

4. The method of claim 1, further comprising applying the interference oscillation briefly during operation of the engine.

5. The method of claim 1, further comprising applying the interference oscillation for at most about three seconds.

6. The method of claim 1, further comprising applying the interference injecting fuel to the cylinders for at most about two seconds.

7. The method of claim 1, further comprising driving the flywheel to rotate by rotating the crankshaft for the engine; and applying the interference oscillation for at most about 30 crankshaft revolutions.

8. The method of claim 1, further comprising driving the flywheel to rotate by rotating the crankshaft for the engine; and applying the interference oscillation for at most about 20 crankshaft revolutions.

9. The method of claim 1, wherein the first ones of cylinders are a first group of alternating cylinders and the second ones of the cylinders are a second group of cylinders which alternate with the first group of cylinders;

the method further comprising:

arranging multiple cylinders in an ignition sequence and injecting fuel to the cylinders to operate in the ignition sequence of the engine;

generating the interference oscillation by supplying the first group of cylinders with more fuel in the ignition sequence, and by supplying the second cylinders with less fuel in the ignition sequence.

10. The method of claim 9, wherein the interference oscillation is generated at a frequency corresponding to half the ignition frequency of the engine.

11. The method of claim 9, wherein a first cylinder in the ignition sequence of the cylinders is a first cylinder which receives more fuel.

12. The method of claim 9, wherein a first cylinder in the ignition sequence of the cylinders is a first cylinder which receives less fuel.

13. The method of claim 1, wherein the engine has an even number of cylinders wherein the cycle position is corrected by a number of steps in the ignition sequence corresponding to one crankshaft revolution.

14. The method of claim 1, wherein the fuel injection has a start setting, and the method further comprises setting the start of the fuel injection to ensure that the engine is able to briefly run even during an incorrect cycle position and during the time when the interference oscillation is applied.

15. An arrangement for determining where the cylinders of a multiple cylinder engine are located in their operating cycles for a multiple cylinder, four-stroke cycle, internal combustion engine, wherein the engine includes a plurality of engine cylinders, a crankshaft driven to rotate by the operation of the engine cylinders, a flywheel connected with the crankshaft for being rotated by the crankshaft, a respective fuel injector for injecting fuel to each of the cylinders in a selected ignition sequence;

the determining arrangement comprising:

a rotation angle sensor for sensing the rotation position of the flywheel and for generating a flywheel position signal, a control unit connected to the rotation angle sensor for receiving a position signal from the rotation angle sensor, and the control unit being connected with the fuel injectors for controlling fuel supply to the cylinders;

the control unit being operable so that as the engine operates, the control unit establishes a respective injection of fuel to different ones of the fuel injectors, causing injection of a first amount of fuel to first ones of the cylinders and a second amount of fuel to second ones of the cylinders, for thereby generating interference oscillations on the flywheel, the interference oscillations having a predetermined first phase position and the interference oscillations being superimposed on ordinary ignition pulse oscillations of the flywheel caused by the injection of the fuel, the control unit being operable also to separate the superimposed interference oscillations from resultant oscillations resulting from the interference oscillations and the ignition pulse oscillations, the resultant oscillations having a second phase position;

the control unit being operable to compare the first phase positions of the interference oscillations with corresponding second phase positions of the resultant oscillations and based upon the comparison, to establish whether the control unit is operating in either a correct or an incorrect cycle position, wherein the control unit is considered to be operating in the correct cycle position when the first phase positions also appears in a predetermined relationship to the second phase positions, but the control unit is considered to be operating in an incorrect cycle position if the first phase positions do not appear in the predetermined relationship to the second phase positions, and the control unit being operable so that if the control unit is operating in an incorrect cycle position, the control unit initiates a correction of its cycle position until the correct cycle position is attained.

16. The arrangement of claim 15, wherein the control unit is operable to inject the first and second amounts of fuel to the cylinder at startup of the engine.

17. The arrangement of claim 15, wherein the correct cycle position comprises the predetermined relationship of the first and second positions and occurs when the interference oscillation and the resultant oscillations are in place, and the control unit is operable to correct the cycle position when the first phases of the interference oscillations and the second phase of the resultant oscillations are out of place.

18. The arrangement of claim 15, wherein the cylinders of the engine operate in an ignition sequence and the control unit is operable so that on starting, the control unit operates the fuel injectors to provide every other cylinder in the ignition sequence of the engine with more fuel so that every other cylinder is one of the first cylinders and supplies the alternate cylinders between every other cylinder with less fuel, and so that the alternate cylinders are the second ones of the cylinders.

19. The arrangement of claim 18, wherein the control unit generates interference oscillations with a frequency corresponding to half the ignition frequency of the engine.

20. The arrangement of claim 15, wherein the control unit is operable to apply the interference oscillations briefly.

21. The arrangement of claim 15, wherein the control unit is operable to apply the interference oscillations for at most about three seconds.

22. The arrangement of claim 15, wherein the control unit is operable to apply the interference oscillations for at most about two seconds.

23. The arrangement of claim 21, wherein the fuel injection system of the engine has a start setting and the control unit is operable to enable operation of the engine even in an incorrect cycle position during the time while the interference oscillation is being applied.

24. A method of determining where in their operating cycles the cylinders of an engine are located for a multiple cylinder internal combustion engine with fuel injection, wherein the cylinders drive a crankshaft to rotate, the method comprising:

during operation of the engine, determining a rotation angle of the flywheel on the rotating crankshaft of the engine and generating a position signal representative of the rotation angle of the flywheel;

injecting a first amount of fuel to at least a first one of the cylinders and injecting a second amount of fuel different than the first amount of fuel to at least a second one of the cylinders for subjecting the rotating flywheel to ignition pulses each time an amount of fuel is injected which produce ignition pulse oscillations of the crankshaft rotation as fuel is supplied to each cylinder and for also subjecting the crankshaft to interference oscillations caused by the supplying of different amounts of fuel, wherein the interference oscillations have predetermined first phase positions;

the crankshaft having a pattern of resultant oscillations resulting from the ignition pulses and from the interference oscillations superimposed on the ignition pulse oscillations, wherein the resultant oscillations have second phase positions; determining the superimposed interference oscillations and the first phase positions thereof from the resultant oscillations of the flywheel;

comparing the predetermined first phase positions of the interference oscillations with corresponding second phase positions of the resultant oscillation pattern, and if the predetermined first phase positions of the interference oscillations appear also for the second phase positions of the resultant oscillation pattern, then a control unit for fuel injection to the cylinder is considered to be operating in the correct cycle position; and if the predetermined first phase positions of the interference oscillations differ from the second phase position of the resultant oscillation pattern, operating in an incorrect cycle position, then correcting the cycle position of the fuel injections by a number of steps in the ignition sequence until the correct cycle position is attained.

25. An arrangement for determining where the cylinders of a multiple cylinder engine are located in their operating cycles for a multiple cylinder, internal combustion engine, wherein the engine includes a plurality of engine cylinders, a crankshaft driven to rotate by the operation of the engine cylinders, a respective fuel injector for injecting fuel to each of the cylinders in a selected ignition sequence;

the determining arrangement comprising:

a rotation angle sensor for sensing the rotation position of the crankshaft and for generating a crankshaft position signal, a control unit connected to the rotation angle sensor for receiving a position signal from the rotation angle sensor, and the control unit being connected with the fuel injectors for controlling fuel supply to the cylinders;

the control unit being operable so that as the engine operates, the control unit establishes a respective injection of fuel to different ones of the fuel injectors, causing injection of a first amount of fuel to first ones of the cylinders and a second amount of fuel to second ones of the cylinders, for thereby generating interference oscillations on the flywheel, the interference oscillations having a predetermined first phase position and the interference oscillations being superimposed on ordinary ignition pulse oscillations of the flywheel caused by the injection of the fuel, the control unit being operable also to separate the superimposed interference oscillations from resultant oscillations resulting from the interference oscillations and the ignition pulse oscillations, the resultant oscillations having a second phase position;

the control unit being operable to compare the first phase positions of the interference oscillations with corresponding second phase positions of the resultant oscillations and based upon the comparison, and if the first phase positions do not appear in a predetermined relationship to the second phase positions, the control unit being operable to initiate a correction of its cycle position until the first and second phases have the predetermined relationship.

* * * * *